United States Patent [19]

Schmoeger

[11] 4,332,198

[45] Jun. 1, 1982

[54] PRINTING PRESS WITH AN AIR ASSIST SHEET DELIVERY AND POWDERING SYSTEM

[76] Inventor: Duane A. Schmoeger, 149-B Jones Franklin Rd., Raleigh, N.C. 27606

[21] Appl. No.: 162,163

[22] Filed: Jun. 23, 1980

[51] Int. Cl.[3] ..... B41F 23/04; B41F 23/06

[52] U.S. Cl. ..... 101/416 B; 271/195

[58] Field of Search ..... 101/416 B; 271/177, 271/195

[56] References Cited

U.S. PATENT DOCUMENTS

| | | | |
|---|---|---|---|
| 1,386,426 | 8/1921 | Riddle | 239/590.5 X |
| 1,902,436 | 3/1933 | Joachim | 271/177 |
| 2,093,995 | 9/1937 | Blow | 101/416 B |
| 2,299,259 | 10/1942 | Sites | 271/177 |
| 2,609,240 | 9/1952 | Faulkner et al. | 239/553.5 X |
| 2,817,310 | 12/1957 | Ponzini | 101/416 B |
| 3,050,416 | 8/1962 | Yahnke et al. | 101/416 B X |
| 3,333,570 | 8/1967 | Paasche | 101/416 B |
| 3,537,704 | 11/1970 | Bond | 271/220 X |
| 3,897,052 | 7/1975 | Turman et al. | 271/220 X |
| 4,062,536 | 12/1977 | Michelson | 271/195 X |

*Primary Examiner*—Clifford D. Crowder

*Attorney, Agent, or Firm*—Mills & Coats

[57] ABSTRACT

A standard offset printing press has the delivery end thereof modified with an air nozzle that is disposed above an underlying sheet travel path and which is designed to direct a continuous stream of pressurized air against the paper's top surface as it emerges from the printing press and is directed into a stacking area about the delivery end. The presence of the downwardly directed air tends to flatten the respective sheets and to prohibit curling. In addition, the printing press of the present invention is provided with a system for dispensing powder onto respective printed sheets such that once stacked the powder tends to separate the respective sheets.

11 Claims, 12 Drawing Figures

PRINTING PRESS WITH AN AIR ASSIST SHEET DELIVERY AND POWDERING SYSTEM

FIELD OF INVENTION

The present invention relates to printing presses of the off-set type and more particularly to air and powdering systems that facilitate the orderly transfer and stacking of sheet paper after printing.

BACKGROUND OF THE INVENTION

Off-set printing presses are widely used today. Stacked paper is placed in the feeder of the press and by the provision of an air blast and vacuum the top sheet is separated from the stack and fed into the press for printing. The entering sheet is directed between an impression cylinder and a blanket cylinder where the printing image is transferred from the blanket cylinder to the sheet of paper being carried between the impression cylinder and blanket cylinder. The sheet is then ejected into the delivery end of the printing press where the respective sheets are stacked one over the other.

It is important to appreciate that the above-described printing process is carried out at very high speeds. With such high speeds there is much opportunity for problems especially in the area of the final transfer and stacking of the printed sheets. In this regard, at the speeds in which the printing presses operate, it is difficult to effectively transfer and stack the printed sheets one over the other without the sheets curling and/or becoming misaligned.

More particularly and with respect to stacking, there are numerous factors and conditions that can affect the stacking ability of paper. Humidity, temperature, ink supply on the press rollers, water supply on the rollers, static electricity, operating speed of the press, paperweight type, and size and grain direction all can enter into stacking problems. Long grain paper has better stability because the grain itself holds the sheet out. Short grain paper has the least ability because its strength is applied only to the shortest distance. Long grain paper is of course preferred but is not always available. But even so, long grain paper can fall victim to the elements mentioned above but not to a degree as short grain paper.

In addition, the friction between the respective sheets tends to inhibit the quick and orderly transfer of respective sheets. Also in certain presses the ink is still wet during stacking and this gives rise to the transfer of ink from the top of one sheet to the back of an overlying sheet. Thus there is a need in such printing presses to improve the movement efficiency of the respective sheets and to prohibit the transfer of ink from one sheet to another.

SUMMARY OF INVENTION

The present invention entails a printing press of the high speed off-set type that is provided with a system for directing air against sheets being ejected into the delivery end of the press so as to assist in the orderly and neat stacking of the respective sheets after printing and to generally prohibit the sheets from curling and becoming misaligned. In addition, the present invention entails a powdering system for such an off-set printing press where powder is dispersed over the respective sheets after printing. The presence of the powder enables the sheets to more easily move and the presence of the powder tends to separate the respective sheets once they are stacked such that ink is not transferred between the stacked sheets.

To supply the air to assist in stacking the respective printed sheets, there is provided an air nozzle and a flexible air supply tube that is operatively connected to a source of pressurized air. The nozzle is designed to supply a continuous stream of pressurized air to the underlying passing sheets. Of particular importance is the design of the nozzle itself which is such that a transverse width of air generally as wide as the paper being stacked is continuously directed against the paper being delivered to the delivery end of the printing press.

Of particular significance with respect to the powdering system is the powder dispensing control which amounts to an "off-on" system wherein powder is only dispersed to a sheet as the same is passing thereunder, after which the powdering system is automatically switched off such that there is no waste of powder and the printing press is maintained relatively free of powder.

It is, therefore, an object of the present invention to provide a printing press with an air and powdering dispensing system that will assist in the orderly and neat stacking of printed sheets and which will generally prevent sheet paper from curling and becoming misaligned during final stacking, all of which enables the press to operate at greater speeds and reduces paper waste.

Another object of the present invention is to provide a means for a printing press for directing a stream of pressurized air against the respective sheets entering the delivery end of said printing press wherein the stream of air is intended to flatten the sheets, prevent curling, and to generally contribute to the neat and orderly alignment and stacking of the sheets even at high speeds.

A further object of the present invention resides in the provision of a powdering system for an off-set printing press wherein the powdering system is of an "on-off" type and designed so as to only disperse powder on underlying passing sheets, wherein the presence of powder on the respective sheets tends to facilitate the transfer of sheets and generally serves to slightly separate the sheets once stacked to prevent ink from being transferred from one sheet to another.

Another object of the present invention resides in the provision of a combination air and powdering system of the character described above that is designed to work in conjunction with each other and to be utilized by the same printing press.

Other objects and advantages of the present invention will become apparent from a study of the following description and the accompanying drawings which are merely illustrative of the present invention.

AIR AND POWDERING SYSTEM FOR A PRINTING PRESS

Figure 1:
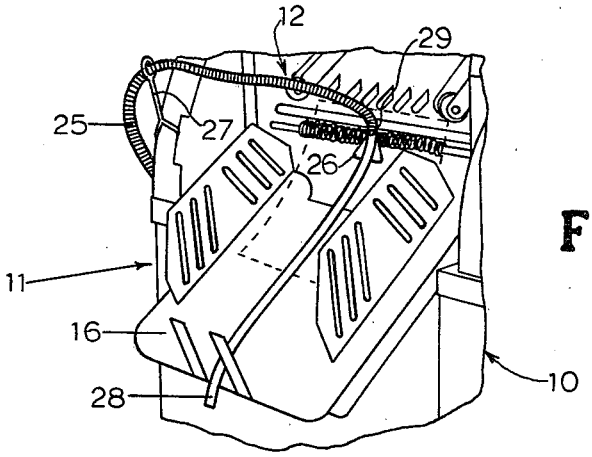
FIG. 1 is a perspective view of the delivery end of a conventional off-set printing press illustrating the system for directing air against sheets being directed to the delivery end of the press.

With reference to FIG. 1, a standard off-set printing press 10 is shown therein and includes an attachment added to delivery end 11 thereof to aid in the neat and orderly delivery and stacking of the freshly printed papers as they emerge from delivery end 11. Press 10, as illustrated, is a Model 2850, Multilith Offset Press as manufactured by Addressograph-Multigraph Corporation of Cleveland, Ohio. Such a press operates at relatively high speeds.

A general description of the operation of printing press 10 and the related problems will be given. A detailed discussion of the entire press is not necessary because such is not material per se to the present invention, and further because such is known since such presses are commercially available.

The sheet alignment apparatus 12 of the present invention is dispersed on delivery end 11 of printing press 10. Printing press 10, regardless of its brand name, uses basically the same system pertaining to sheet control. The paper to be printed is stacked in a feeder (not shown). Press 10 includes a pump 20 (FIG. 11) that provides the necessary air blast 21 to separate the top sheets and vacuum 22 to lift up the top sheet and feed it into press 10. Air blast and vacuum valve controls 23, 24 are typically provided. Respective sheets move over feed board 19 and are gripped by a row of gripper fingers 13 on impression cylinder 14. The sheet is squeezed between impression cylinder 14 and blanket cylinder 15 below plate cylinder 17 thus transferring the printed image from blanket cylinder 15 to the sheet as the two cylinders 14, 15 turn together. Respective sheets are then ejected by means of ejector wheels 18 into paper collector 16 of printing press 10. This is typically at very high speed.

Figure 2:
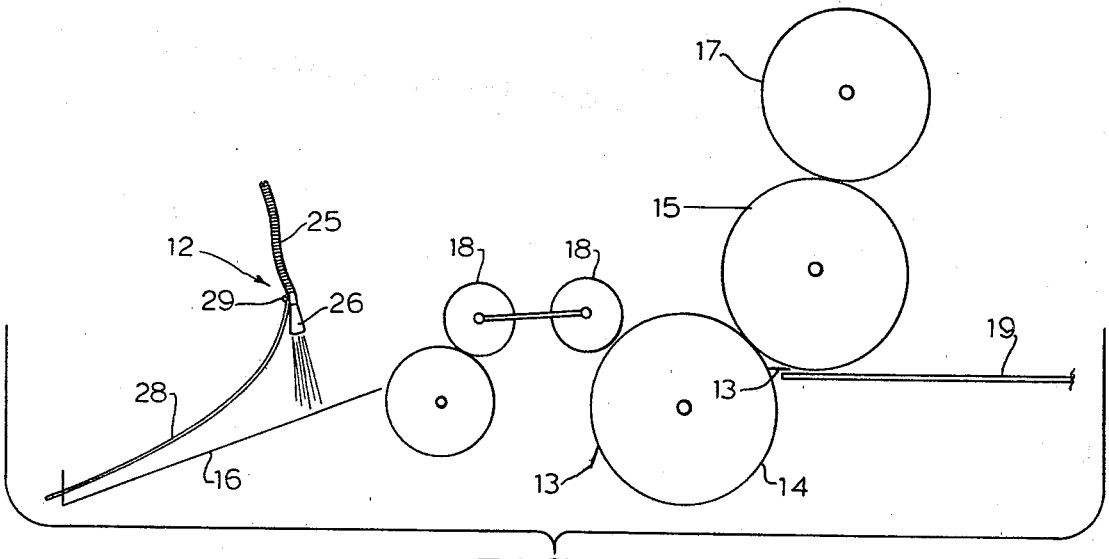
FIG. 2 is a schematic illustration of the delivery end of the printing press and basic printing cylinders found in such an off-set printing press.

Viewing FIGS. 1 and 2, printing press 10 has mounted thereon, at delivery end 11, the sheet alignment apparatus 12. Sheet alignment apparatus 12 includes a flexible tube 25 and nozzle 26. Flexible tube 25 is adjustably mounted on the framework of press 10 by clamp 27. Tube 25 may be made from bendable metal tubing and is of the type which is easily bendable but which once bent retains its position relative to the delivery end 11 of press 10.

A leaf spring 28 is fixedly mounted on a portion of the press and extends downward and outward so as to guide the sheets from press 10 once the printing operation is completed. In the present embodiment, leaf spring 28 is no longer secured to press 10 but is secured to a portion of nozzle 26 by screw 29. Leaf spring 28 is situated along with nozzle 26 adjacent delivery end 11 of press 10 so as to aid in guiding the printed paper from delivery end 11 and aids in the orderly stacking thereof.

Figure 7:
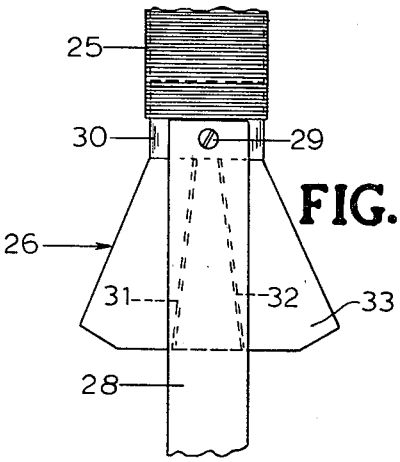
FIG. 7 is an enlarged front elevational view of the nozzle associated with the air system of the present invention.
Figure 8:
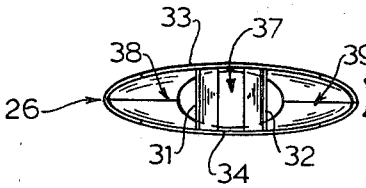
FIG. 8 is a bottom view of the nozzle.
Figure 9:
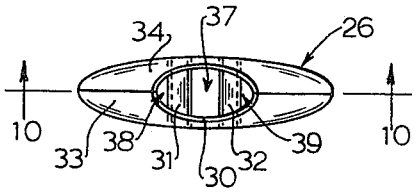
FIG. 9 is a top plan view of the nozzle.
Figure 10:
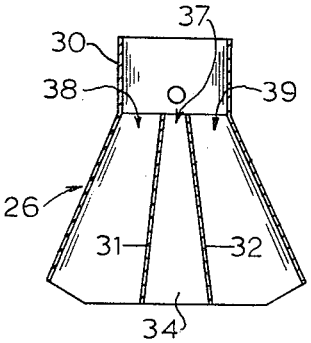
FIG. 10 is a sectional view taken along lines 10—10 of FIG. 9.
Figure 11:
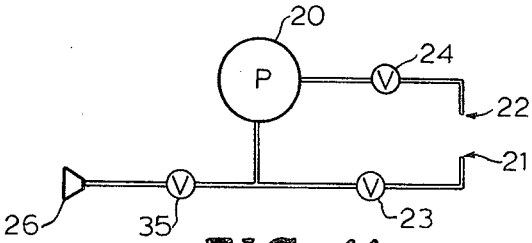
FIG. 11 is a schematic illustration of a typical pump system adapted for use with one embodiment of the present invention.
Figure 12:
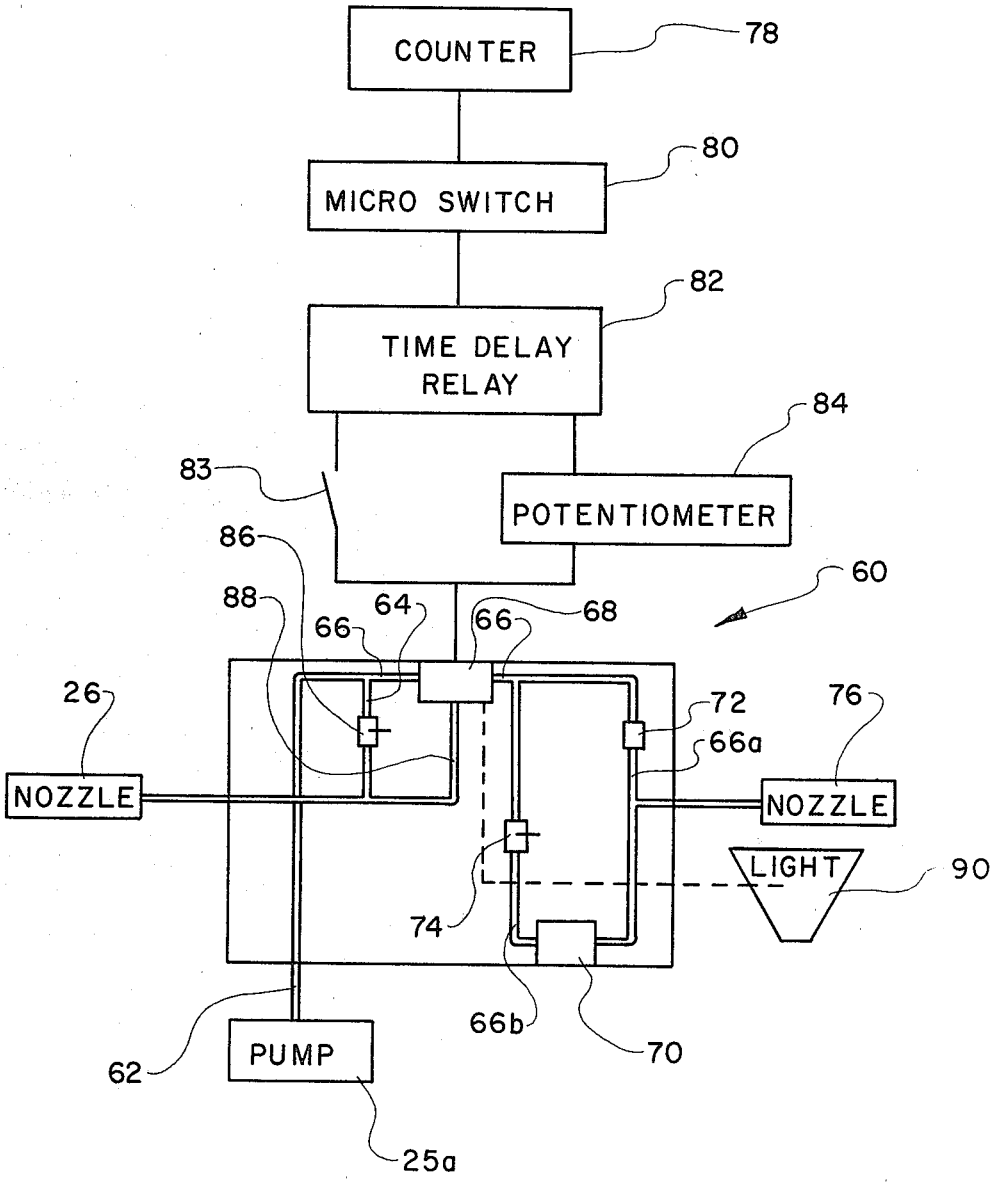
FIG. 12 is a schematic illustration of the powdering system of the present invention.

Nozzle 26 is removably attached to tube 25 as tube 25 fits over sleeve portion 30 of nozzle 26 (see FIGS. 7, 8, 9 and 10). As shown in FIGS. 7 and 10, nozzle 26 is substantially of an equilateral triangle shape with the sleeve portion 30 being formed in the apex thereof. In plan, FIGS. 8 and 9, nozzle 26 presents a substantially elongated elliptical shape. Previously mentioned leaf spring 28 is secured to sleeve portion 30 of nozzle 26 by screw 29. Nozzle 26 has vanes 31, 32 rigidly secured within walls 33, 34 of nozzle 26. Opening 37 at its entrance is substantially smaller in area than the entrances to openings 38, 39 of nozzle 26. Thus, some predetermined amount of air is channeled through opening 37 but the predominant air supply goes to openings 38, 39 and to the sides of nozzle 26. It has been found desirable to achieve a substantially even distribution of pressurized air all the way across the sheet as it emerges from delivery end 11. The nozzle 26 is designed to supply at its discharge end a 2" to 3" wide continuous stream of pressurized air to the sheet which reaches and substantially strikes the entire width of the sheet. A wider stream can be achieved by raising nozzle 26 and a narrower stream may be achieved by lowering nozzle 26. The continuous air stream is most effective and insures proper sheet alignment throughout the entire range of delivery. Appropriate adjustment of the air supply may be desired so that dependent upon the grade or weight of paper, the pressure may be adjusted by use of a valve 35, as illustrated in FIG. 11 or a valve 86, as illustrated in FIG. 12. Thin paper tends to buckle up under excessive pressure. The present system was designed for an air flow range of 5.5 S.C.F.H. to 53.4 S.C.F.H. and for operating with a pressure range of between 3.11 p.s.i. to 1.8 p.s.i.

Figure 3:
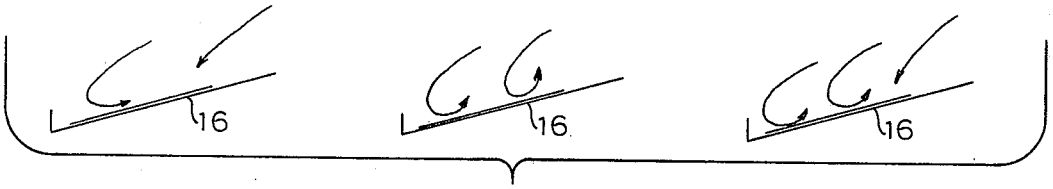
FIG. 3 is a series of views illustrating the up-curl problem as encountered in printing presses.
Figure 4:
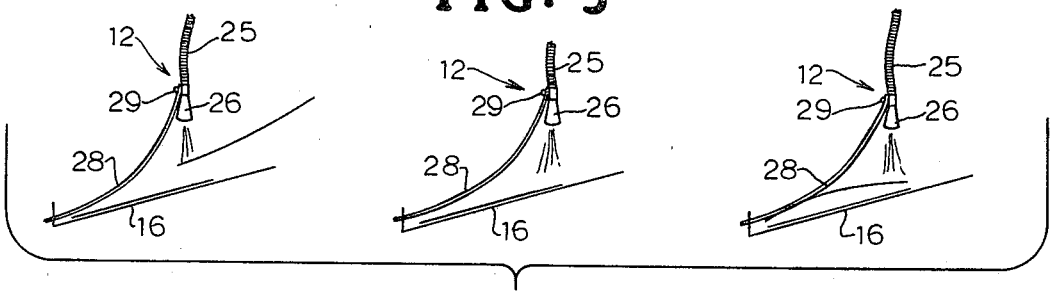
FIG. 4 is a series of views illustrating how the up-curl problem is dealt with by the air system of the present invention.

The present invention may be utilized in any of several ways. FIG. 3 illustrates application of the invention apparatus to the up-curl problem. Referring to FIG. 4, the air blast from nozzle 26 keeps the curl-down to a workable tolerance by blowing down the center of the sheet. This helps to hold up the lead edge of the sheet to prevent rolling.

Figure 5:
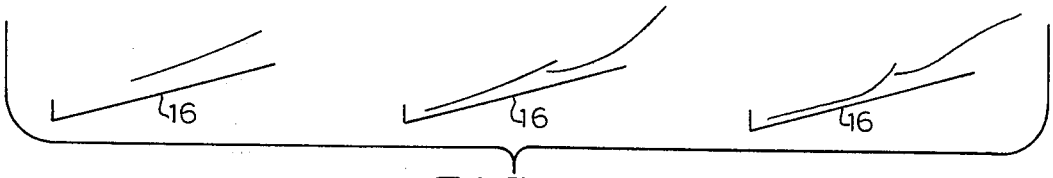
FIG. 5 is a series of views illustrating the curl-down problem as encountered in printing presses.
Figure 6:
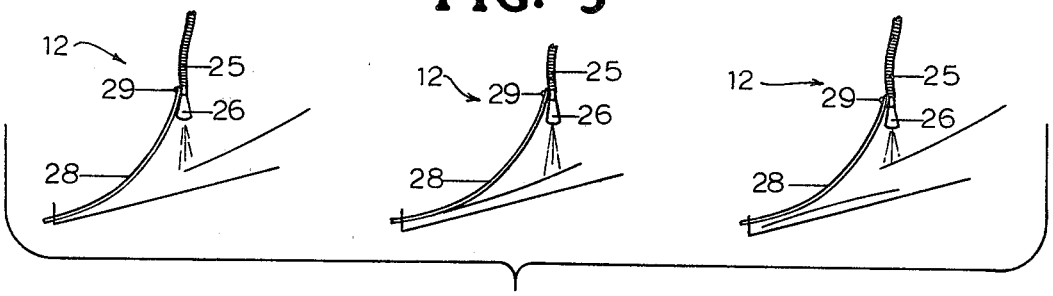
FIG. 6 is a series of views illustrating how the curl-down problem is dealt with by the air system of the present invention.

FIG. 5 illustrates application of the invention apparatus to the down-curl problem. Referring to FIG. 6, the air blast from nozzle 26 helps to guide the entire sheet into paper collector 16, but is especially instrumental in moving the tail of the sheet out of the way of the oncoming sheet. In the FIG. 5 type of operation, the tail of the sheet prior to use of the invention would often not fall out of the way quickly enough to allow passage of the oncoming sheet.

The height of the nozzle 26 above the sheet is normally critical. A narrow width sheet requires nozzle 26 to be located relatively close to the sheet surface. A wider width sheet requires nozzle 26 to be raised to a relatively higher level to cover the entire surface. It has been found that when printing an $8\frac{1}{2} \times 11$ sheet, nozzle 26 is best positioned approximately $1\frac{1}{2}$" above the top surface of the sheet in order to get the proper air spread at the set air pressure. Also, the described unique vane or fin like air flow structure and shape used for nozzle 26 has been found to be of material assistance to achieve the object of the invention.

With reference to FIG. 12, there is shown therein a schematic illustrating both the air and powdering system of the present invention and this is indicated generally by the numeral 60. In this regard, pump 25*a* is communicatively connected to a supply line 62 that branches into a Y to yield an air line 64 and a powdering line 66.

First with respect to the air line 64, the same includes a flow control valve 86 that allows the air flow passing therein to be adjusted. Air line 64 is communicatively connected with the air nozzle 26 already described that is positioned about the delivery end of the printing press for directing pressurized air downwardly onto the under passing sheets.

Turning now to the powdering system of the present invention, it is seen that the powdering line 66 leads to a solenoid valve 68. Extending from the solenoid valve is a continuating powder line 66 and an air return line 88 that joins air line 64. Solenoid valve 68 is designed such that in an actuated mode air passing through line 66 is directed on through the solenoid valve into the continuation of line 66. In a deactuated mode, air entering the solenoid valve 68 through line 66 is directed back through return line 88 which joins air line 64. Consequently it is appreciated that in this design, air continues to flow through the solenoid valve 68 as long as pump 25*a* is operating.

Viewing continuating powdering line 66 leaving the solenoid valve 68, it is seen that the same leads into a Y circuit including an air by-passing line 66*a* and line 66*b* which is communicatively connected to a powder source 70. Within line 66*a*, there is provided a restrictor 72 and within line 66*b* there is provided an adjustable control valve 74. This Y-branch along with the presence of restrictor 72 and valve 74 assures a generally constant air flow through line 66 to a dispersing nozzle 76. This design also generally contributes to an even distribution of powder in the air pulse passing through line 66*b* and passing through nozzle 76.

Thus it is appreciated that the powdering system is of an "on-off" type and is controlled by the actuation and deactuation of solenoid 68. To provide this control, the printing press in a conventional fashion is provided with a counter 78. Operatively associated with counter 78 is a microswitch that is designed to be actuated in response to the counter being actuated by each advancing sheet. Microswitch 80 is in turn operatively connected to a time delay relay 82 having a switch 83 and a potentiometer 84 associated therewith. Potentiometer 84 can be adjusted to vary the time interval of actuation of the time delay relay 82. It is appreciated that the significance of this is that for various lengths of paper the potentiometer can be adjusted such that powder is only dispersed onto the paper and for the time period equivalent to the time required for the paper to pass under the powder dispersion nozzle 76.

In some printing presses especially of the type having provisions for the chain delivery of printed sheets to a stacking area, the air and powdering system will include both an air nozzle 26 and one or more powdering nozzles 76. Such chain delivery printing presses are conventional and known in the art. In other cases, the air nozzle 26 and powdering nozzle 76 may in fact be the very same nozzle, providing both for the dispensing of powder and air. In the case where there is provided a separate air nozzle 26 and a separate powdering nozzle 76, it is appreciated that the design illustrated in FIG. 12 is important inasmuch as any time the solenoid valve 68 is inoperative to transfer air to the powder source 70, that the air being delivered to the solenoid valve 68 is redirected back into air line 64 for dispensing through the air nozzle 26. This assures a continuous, generally equal flow rate of air through the air and powdering system of the present invention.

It is thusly appreciated that the present invention may operate as either an air system only or as an air and powdering system. As an air system only, solenoid valve 68 is placed in an inoperative mode by opening switch 83. Valve 86 is opened and all the air from pump 25*a* is directed through valve 86 and nozzle 26.

In the air and powdering mode, valve 86 is closed and switch 83 is closed. Solenoid 68 is periodically actuated, allowing all the air to pass therethrough into line 66 for powdering. The deactuation of solenoid 68 results in all the air being directed into line 88 and air nozzle 26. Consequently the present invention is both an "on-off" powdering and air system, as both powder and air are dispersed during separate but succeeding time intervals.

Also, to aid in properly adjusting potentiometer 84, a light 90 is actuated "on" and "off" with solenoid 68. The light is positioned adjacent nozzle 76 and thusly by judging the position of the leading and trailing edges of the paper with respect to nozzle 76 while the light is "on", the potentiometer 84 can be appropriately adjusted.

From the foregoing specification, it is appreciated that the present invention is very useful when used in conjunction with high speed off-set printing presses in facilitating the stacking of printed paper. The air serves to assist in aligning and orienting the respective sheets of paper during stacking while the powder serves to separate adjacent sheets from each other when stacked in addition to serving as a form of a lubricant that allows the sheet paper to move more freely within the printing press. It is believed that the present invention provides a substantial advancement in the art with regard to transferring and stacking sheet paper within a printing press.

The present invention, of course, may be carried out in other specific ways than those herein set forth without departing from the spirit and essentical characteristics of the invention. The present embodiments are, therefore, to be considered in all respects as illustrative and not restrictive, and all changes coming within the meaning and equivalency range of the appended claims are intended to be embraced therein.

What is claimed is:

1. In a printing machine having printing means for transferring printing matter onto respective paper sheets passing through the printing machine and including a delivery end for receiving the printed sheets wherein within the delivering end there is provided a stacking area where the printed sheets can be stacked one on top of another, the improvement comprising an air and powder dispersion system for separately dispersing powder on respective sheets prior to stacking and prior to another sheet being stacked thereon and for separately directing air against respective sheets after powdering as they are stacked so as to assist in the neat and orderly stacking thereof, said air and powder dispersion system comprising: a source of compressed air; nozzle support means adjustably mounted about said delivery end generally above the sheet stacking areas; air dispersing nozzle means secured to said nozzle support means and communicatively connected to said source of compressed air for receiving air therefrom and for directing the air downwardly therefrom onto the respective sheets being stacked; a time controlled on-off powdering system including a source of powder communicatively connected to an air source means; powder dispersing means separate and independent of said air dispersing nozzle means and communicatively connected to said source of powder and generally disposed about the delivery end of said printing machine for dispersing powder onto respective sheets being directed to the stacking area prior to the sheets reaching said stacking area and prior to coming into operative contact with air being dispersed by said air dispersing nozzle means, wherein once stacked the powder generally serves to separate the respective stacked sheets and facilitates movement of the sheets during the delivery and stacking process; and control means for controlling the air dispersed by said air dispersing nozzle means and the powder dispensed by said powder dispersing means and for further controlling the time duration of powder dispensing in accordance with the movement of each respective sheet prior to stacking, said control means including on-off powder dispensing control means for sensing the presence of an oncoming sheet and for actuating said powdering system for a selected time interval while the sheet passes under said powder dispersing means such that powder is only dispersed while the sheet is passing under the powder dispersing means.

2. The printing machine with the air and powder dispersing system of claim 1 wherein said control means for controlling the time duration of powder dispersion includes a solenoid valve operative to actuate and deactuate said powdering system, and switch means operatively associated with said printing machine for being selectively actuated by respective advancing sheets passing through said printing machine, and wherein there is provided time delay relay means operatively connected to said switch means and actuated thereby with said time delay means being operatively connected to said solenoid valve for actuating the same a selected time period, resulting in powder being dispersed only for that selected time period.

3. The printing machine with said air and powder dispersing system of claim 2 further including means operatively assoicated with said time delay relay means for adjusting the actuation period of said solenoid valve so as to effectively adjust the time interval of powder dispersion for each actuation of said solenoid valve.

4. The printing machine with said air and powder dispersion system of claim 3 wherein said powdering system includes a first air line leading from said air source to said powder source and a second air line leading from said powder source to said powder dispersing means, and wherein between said air source and said powder source said first air line includes two split segments, each segment having flow restricting means therein with one segment by-passing said powder source and being communicatively connected to said second air line, with said other segment extending to said powder source, whereby the quantity of powder dispersed for any given air flow can be adjusted by adjusting the quantity of air passing through the split segment of said first air line that leads to said powder source.

5. The printing machine with said air and powder dispersing system of claim 1 wherein said control means for controlling the time duration of powder dispersion includes means for effectively transferring all of the air being directed from said air source to said air dispersing nozzle means in response to said powder dispersion system assuming an inoperative state.

6. The printing machine with said air and powder dispersion system of claim 5 wherein said nozzle means includes an outlet end that is generally elliptical in shape with the nozzle being normally positioned such that the long axis of said elliptical outlet extends generally perpendicular to the long axis of the paper passing thereunder.

7. The printing machine with said air and powder dispersing system of claim 6 wherein said nozzle includes a plurality of spaced apart downwardly extending fins for effectively dividing said nozzle into a number of compartments through which air and/or powder may pass therethrough prior to being directed out the outlet end of said nozzle.

8. The printing machine with said air and powder dispersion system of claim 7 wherein said printing machine is provided with leaf spring means operatively connected to said nozzle means and extending therefrom along the delivery end of said printing machine over the defined sheet stacking area, wherein said leaf spring means tends to facilitate stacking as the same generally bears against successive sheets being stacked in said stacking area.

9. The printing machine with said air and powdering system of claim 1 wherein said control means includes means for dispersing air and powdering alternately and in time sequence, whereby for a selected time interval only air is dispersed by said air dispersing nozzle, followed by a time interval in which only said powder dispersing means is operative.

10. The printing machine with the air and powder dispersing system of claim 1 including light means operatively associated with said powdering system and actuated and deactuated therewith, said light means generally focused on said powder dispersing means and the area thereunder where the respective sheets pass, and wherein said light means may be utilized to adjust the time duration of actuation of said powdering system.

11. The printing machine with said air and powder dispersion system of claim 1 wherein said control means includes the means for switching said powdering system completely off independently of the operation of said air dispersing nozzle means, in order that said printing machine may be selectively controlled to only disperse air at said stacking area through said air dispersing nozzle means.

* * * * *